US005791159A

United States Patent [19]

Aicher et al.

[11] Patent Number: 5,791,159

[45] Date of Patent: Aug. 11, 1998

[54] COMPRESSION APPARATUS

[75] Inventors: Walter Aicher, Neftenbach; Heinrich Lorenzen, Untersiggenthal, both of Switzerland

[73] Assignee: Sulzer Turbo AG, Zurich, Switzerland

[21] Appl. No.: 688,598

[22] Filed: Jul. 30, 1996

[30] Foreign Application Priority Data

Jul. 31, 1995 [EP] European Pat. Off. ..... 95810491

[51] Int. Cl.[6] ..... F25B 1/10

[52] U.S. Cl. ..... 62/510

[58] Field of Search ..... 415/114, 115, 415/116; 62/510; 417/251, 244, 62

[56] References Cited

U.S. PATENT DOCUMENTS

| | | | |
|---|---|---|---|
| 3,585,795 | 6/1971 | Grieb | 417/62 |
| 3,889,485 | 6/1975 | Swearingen . | |
| 3,947,146 | 3/1976 | Schuster | 415/116 |
| 3,954,430 | 5/1976 | Curtis et al. | 62/510 |
| 4,019,343 | 4/1977 | Roberts | 62/510 |

FOREIGN PATENT DOCUMENTS

| | | |
|---|---|---|
| 2.040.794 | 1/1971 | France . |
| 3521060 | 12/1985 | Germany . |
| 315986 | 9/1956 | Switzerland . |
| 854127 | 11/1960 | United Kingdom . |
| 2 073 393 | 10/1981 | United Kingdom . |

OTHER PUBLICATIONS

Matile, C. et al., "Hypercompresseurs centrifuges pour éthylène", *Revue Technique Sulzer*, No. 1, 1975, pp. 17–36.

*Primary Examiner*—John T. Kwon

*Attorney, Agent, or Firm*—Townsend and Townsend and Crew LLP

[57] ABSTRACT

The invention relates to a compression apparatus (10) comprising a turbocompressor (1) with a plurality of compression stages (1*a*, 1*b*, 1*c*, 1*d*) as well as infeed flows (5*b*, 5*c*, 5*d*), where the compression apparatus (10) serves for operating a refrigerant circuit, especially with a hydrocarbon gas such as propane, ethylene, methane, or a mixture thereof, wherein a mixer device (8*a*, 8*b*, 8*c*) *is arranged outside the turbocompressor* (1) and wherein a preceding and a succeeding compression stage (1*a*, 1*b*, 1*c*, 1*d*) are connected to one another via the mixer device (8*a*, 8*b*, 8*c*) in such a manner that the infeed flow (5*b*, 5*c*, 5*d*) provided for the succeeding compression stage (1*b*, 1*c*, 1*d*) opens into the mixer device (8*a*, 8*b*, 8*c*) in order to mix the infeed flow (5*b*, 5*c*, 5*d*) with a main flow (6*a*, 6*b*, 6*c*) of the preceding compression stage (1*a*, 1*b*, 1*c*).

10 Claims, 5 Drawing Sheets

COMPRESSION APPARATUS

The invention relates to a compression apparatus discloses a multi-stage turbocompressor for a refrigerant circuit wherein infeed gas and compressed gas are thoroughly intermixed and introduced to successive turbocompressor stages.

BACKGROUND OF THE INVENTION

It is known that turbocompressors can be used for refrigerant circuits in ethylene and ammonia installations or for liquefaction of natural gas and petroleum gas. Such installations are designated as LNG (liquefied natural gas) installations or as LPG (liquefied petroleum gas) installations. Petroleum gases collected at the site of a find are fed in compressed form to an LPG installation. The LPG installation separates the components of this gas from one another by stepwise relaxation and cooling. In installations for liquefying natural gas (LNG installations) the natural gas delivered under pipeline pressure is very strongly cooled by a plurality of refrigerant circuits, which are operated with hydrocarbon gases, especially propane, ethylene or methane. The cooled natural gas is liquefied by a succeeding relaxation. The end product of both processes is a transportable liquefied gas. An LPG or LNG installation requires a considerable cryogenic cooling power. A propane circuit which is operated with a large turbocompressor is often used as a first preliminary cooling step. The propane circuit is generally executed in several cooling stages, with a multi-stage compressor with one or more intermediate infeeds being used. Such a cooling system with a propane circuit and intermediate infeeds is known from "Refrigeration System Stability Linked to Compressor and Process Characteristics, Clifford E Lucas, Chemical Engineering Process, November 1989", with the intermediate infeed known therefrom being illustrated in FIG. 1.

A drawback of this known cooler device is to be seen in that it tends to instable behaviour under certain operating conditions. One reason for this is to be found in the intermediate infeeds, the infeed amount of which can be very large, sometimes larger than the actual main flow in the compression stage. The infeed amount has a lower temperature than the main flow. The mixture of main flow and infeed amount can have an inhomogeneous mixing ratio on entering the rotor, which can lead to instable behaviour in the compression stage.

SUMMARY OF THE INVENTION

A further disadvantage of this known cooling apparatus is that it requires a relatively thick shaft, since the majority of rotors are arranged on the shaft.

This object is satisfied in particular by the fact that a mixer apparatus is arranged outside the turbocompressor, that a compressor stage preceding the mixer device and one following it with reference to the direction of flow are connected to one another via the mixer device, and that the infeed flow provided for the following compression stage opens into the mixer device in order to mix the infeed flow with an outlet flow, or the main flow, of the preceding compression stage.

An advantage of the invention is to be seen in the fact that the mixer device effects a good mixing of the main flow and the infeed flow, so that a fluid with a homogeneous temperature distribution is fed into the succeeding compression stage. This leads to a more stable operating behaviour of the compression stage. A propane refrigeration circuit can have a volume of the intermediate infeeds which is partially larger than that of the main flow and has a lower temperature as well. By mixing these two volume flows outside the compressor it is possible to achieve the result that the machine characteristic can be determined completely independently of the admixed volume and its temperature. A thermodynamic design of a compressor can thus be performed in a completely conventional manner based on the averaged entry state of the fluid.

A further advantage of the invention is to be seen in the fact that the compression apparatus can be divided into several individual compressors. Especially advantageous is the use of compressors with two rotors arranged opposite or counter to one another. The entry of the fluid into the compressor can thereby be arranged to be at the free end. In this way the diameter of the shaft and thus also the Mach number at the inlet to the rotor can be kept small. As a consequence of this the characteristic of the compression stage becomes stable over a broad range. In this way a smaller diameter of the rotor cover plate and thus a smaller inlet Mach number can be achieved for a given speed of rotation and required rotor diameter.

A further advantage of a compression apparatus consisting of a plurality of compressors is to be seen in the fact that the compressor no longer has a long shaft. This would lead to poor mechanical properties and to an instable behaviour especially when the long shaft also has narrow places for receiving the rotor. The compression apparatus in accordance with the invention permits the use of short and also thin shafts.

BRIEF DESCRIPTION OF THE DRAWINGS

The invention will be described in more detail with reference to the exemplary embodiments. Shown are.

DESCRIPTION OF THE PREFERRED EMBODIMENTS

Figure 1:
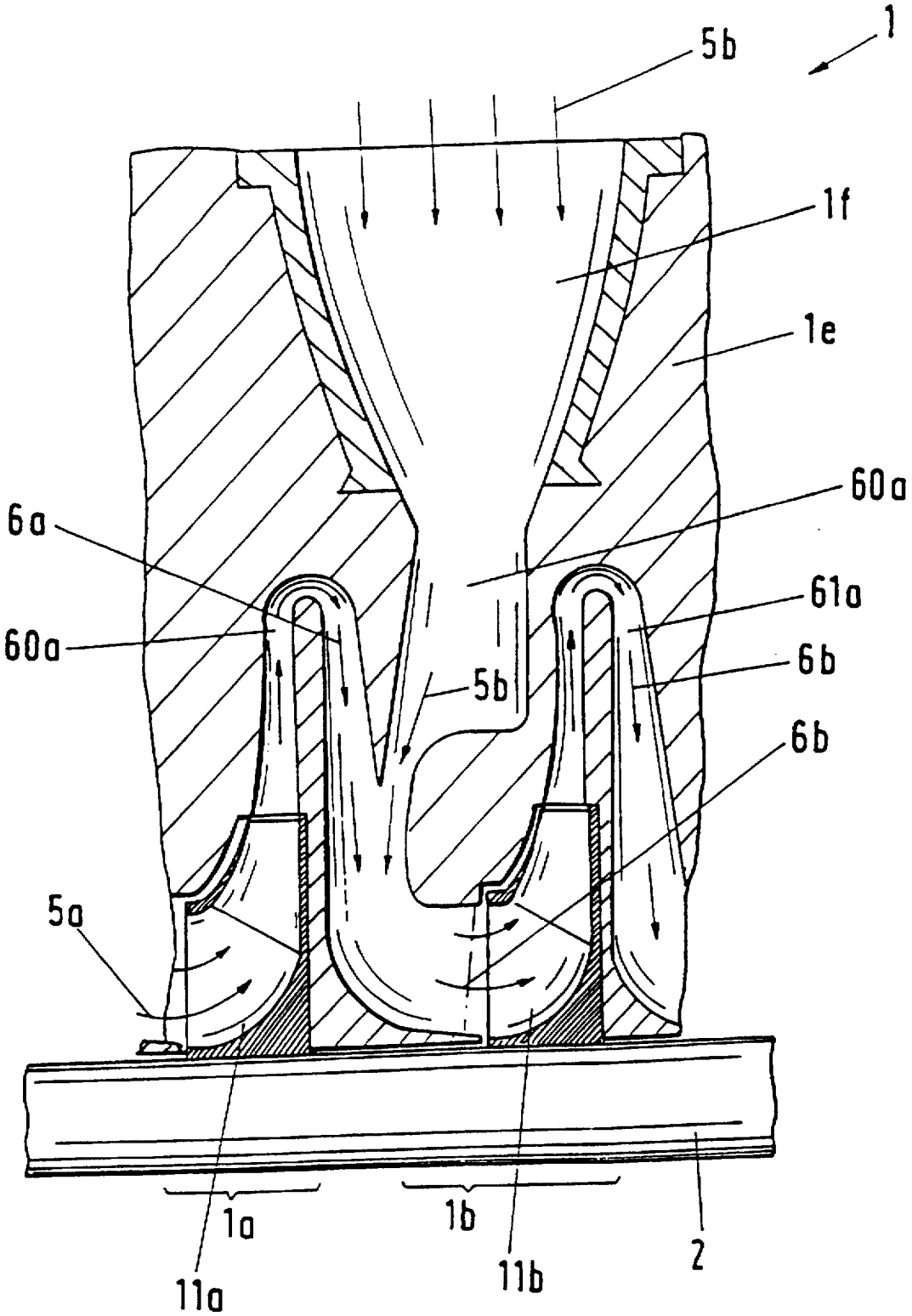
Fig.1 (PRIOR ART)
FIG. 1 is a longitudinal section through a compressor with a known admixing arrangement.

FIG. 1 shows a compressor known from the state of the art with rotors 11*a*, 11*b* arranged on a shaft 2 which serve for the compression of a refrigerant. In the first compression stage the base flow 5*a* is compressed by the rotor 11*a* and emerges again as main flow 6*a*. An infeed flow 5*b* is fed to the compressor 1 via an inlet opening 1f and opens within the compressor housing 1*e* into the main flow 6*a* which has already been compressed by the rotor 11*a*. For this purpose correspondingly formed internal channels 60*a*, 60*b*, 61*a* are arranged in the compressor housing 1*e*. The two flows 6*a*, 5*b* are mixed and further compressed by the following rotor 11*b* to a main flow 6*b*. A disadvantage of this arrangement is seen in the fact that the two flows 6*a*, 5*b* do not mix homogeneously, which can lead to instable behaviour of the flow in the rotor 11*b*.

Figure 3:
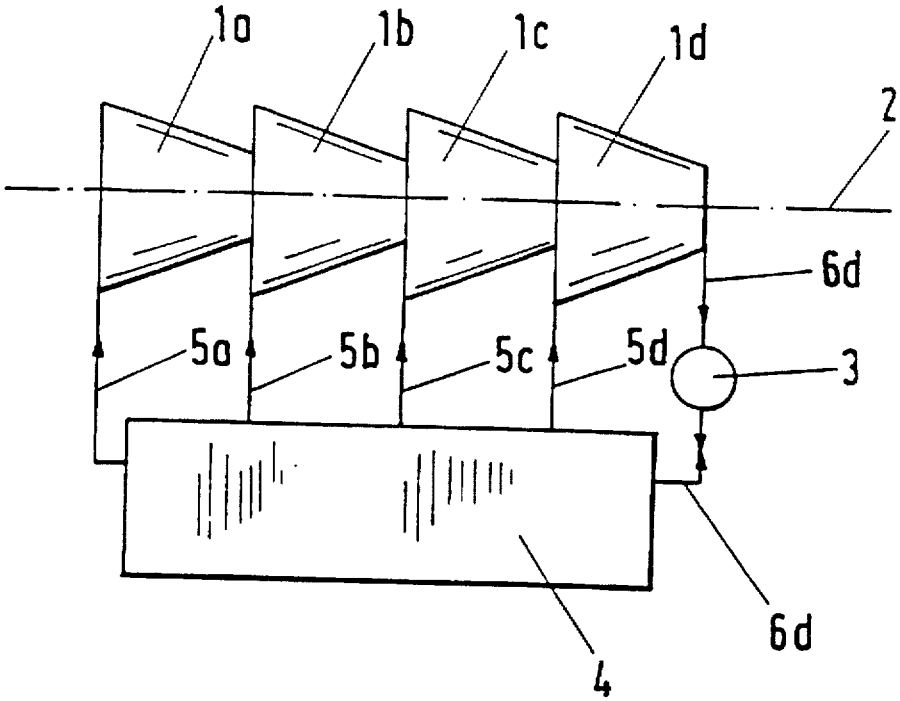
Fig.3 (PRIOR ART)
FIG. 3 is a schematic representation of a compressor with known admixing.

FIG. 3 shows a schematic representation of a known multi-stage refrigerant circuit with propane as used for large cooling circuits in LPG installations or LNG installations. The compressor 4 has compression stages 1*a*, 1*b*, 1*c*, 1*d* arranged in series and on a common shaft 2. The compressed refrigerant arrives via the end flow 6*d* at a condenser 3 and then further at the process 4. The process 4, represented only schematically, feeds feeder currents 5*b*, 5*c*, 5*d* to the individual compression stages 1*a*, 1*b*, 1*c*, 1*d*.

Figure 2A:
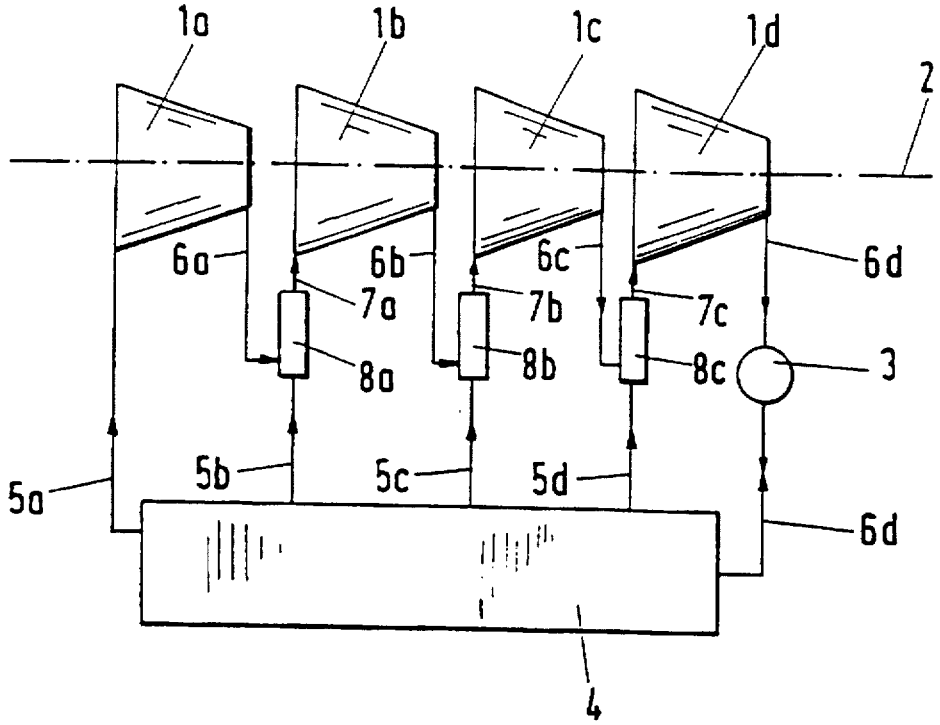
FIG. 2*a* is a schematic representation of the compression apparatus in accordance with the invention.

FIG. 2*a* shows a schematic representation of an embodiment of the compression apparatus in accordance with the invention. This has compression stages 1*a*, 1*b*, 1*c*, 1*d* arranged successively in series on a common shaft 2. The end flow 6*d*, or the final output, then discharges via a compressor 3 into a process 4 not illustrated in further detail. From the process 4 the refrigerant is fed via the basic flow 5*a* as well as the infeed flows 5*b*, 5*c*, 5*d* back to the individual compression stages 1*a*, 1*b*, 1*c*, 1*d*. Here the individual compression stages 1*a*, 1*b*, 1*c*, 1*d* are executed in such a manner that the refrigerant is led back out of the compressor housing 1*e* via an outlet line 6*a*, 6*b*, 6*c*, through which the main flow flows. Outside the compressor housing 1*e* there are arranged mixer devices 8*a*, 8*b*, 8*c* into which both the infeed flows 5*b*, 5*c*, 5*d* and the main flow 6*a*, 6*b*, 6*c* are introduced and, after a mixing of the two flows these are fed back via the infeed lines 7*a*, 7*b*, 7*c* to the compression stages 1*b*, 1*c*, 1*d*. The two flows 5*b*, 6*a* are mixed in the mixer device 8*a* in such a manner that the flow leaves the mixer device 8*a* with a homogeneous temperature distribution as well as a homogeneous velocity distribution and is fed to the compression stage 1*b*. Many embodiments are suitable as the mixer device, including in particular a static mixer, which as is known has within it only statically arranged inserts for homogenising the fluid.

Figure 2B:
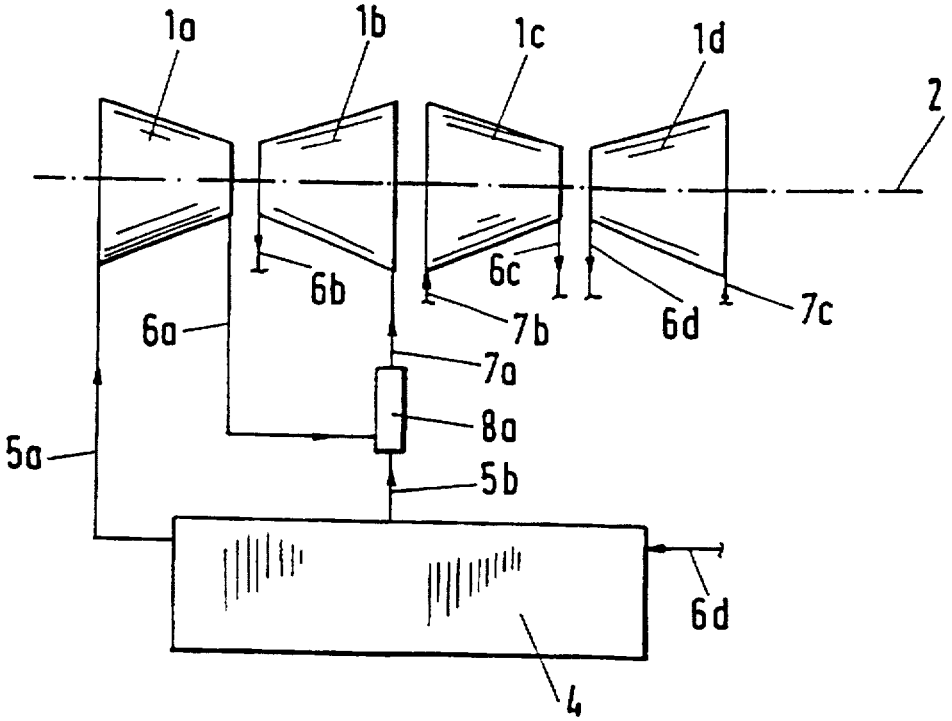
FIG. 2*b* is a schematic representation of a further compression apparatus in accordance with the invention.

An advantage of the invention is to be seen in the fact that the compression stages 1*a*, 1*b*, 1*c*, 1*d* can be arranged in differing manners on the common shaft 2, or can be arranged on a plurality of separate shafts 2. FIG. 2*b* shows a schematically represented exemplary embodiment which is distinguished in comparison with FIG. 2*a* by a differing arrangement of the compression stages 1*a*, 1*b*, 1*c*, 1*d*. Compression stages 1*a*, 1*b*, 1*c*, 1*d* arranged adjacently on the shaft 2 are arranged counter to one another, i.e. the fluid of adjacently placed compression stages 1*a*, 1*b*, 1*c*, 1*d* flows axially in opposite directions. Thus the compression stages 1*a* and 1*b*, or 1*b* and 1*c*, or 1*c* and 1*d* are arranged counter to one another. This arrangement has the advantage that the forces of the compression stages 1*a*, 1*b*, 1*c*, 1*d* acting on the shaft 2 in the direction of the shaft better compensate one another. Otherwise the flow of refrigerant is laid out analogously to that of the exemplary embodiment in accordance with FIG. 2*a* however, only one mixer device 8*a* with the corresponding input and output lines 5*b*, 6*a*, 7*a* is shown for the sake of clarity.

Figure 4:
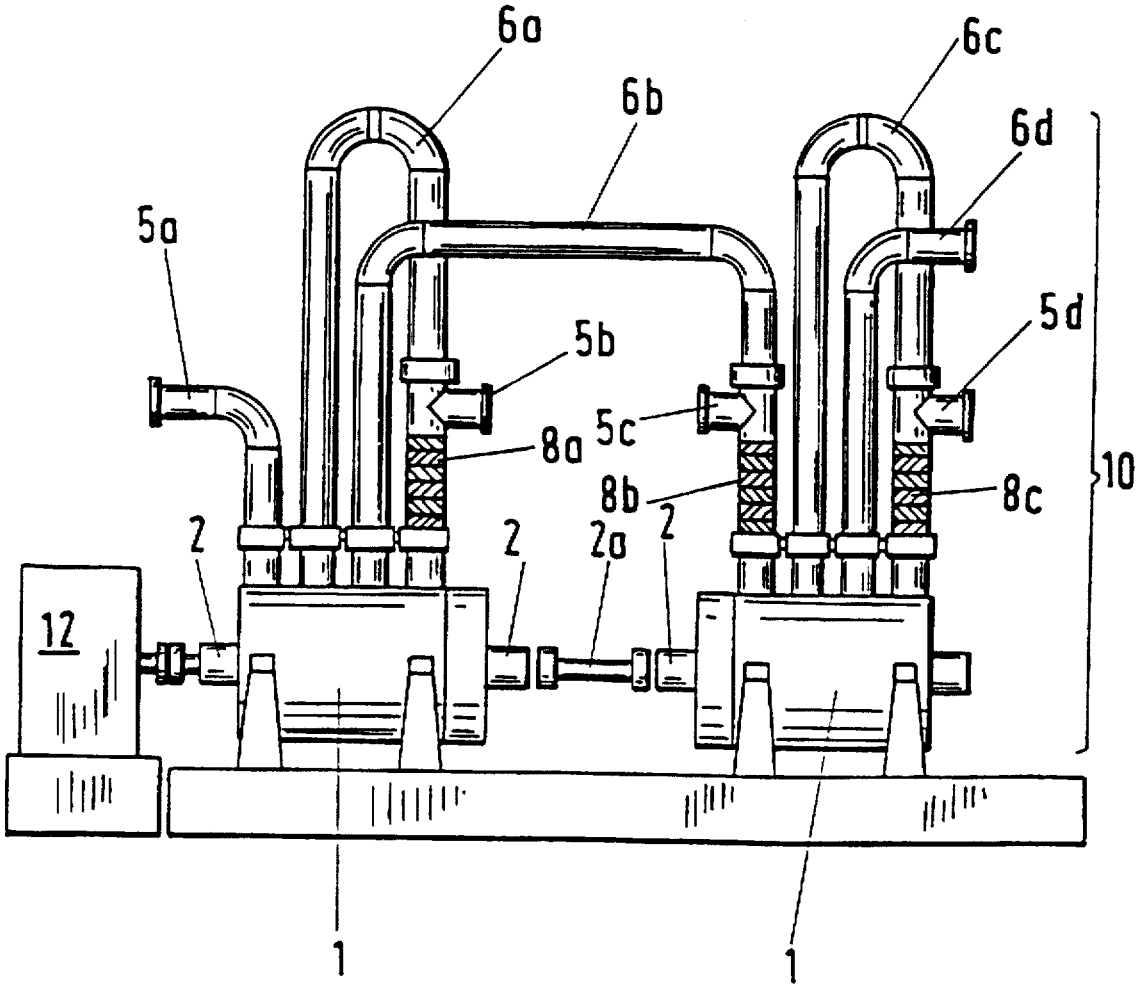
FIG. 4 is a further embodiment of a compression apparatus in accordance with the invention.
Figure 5:
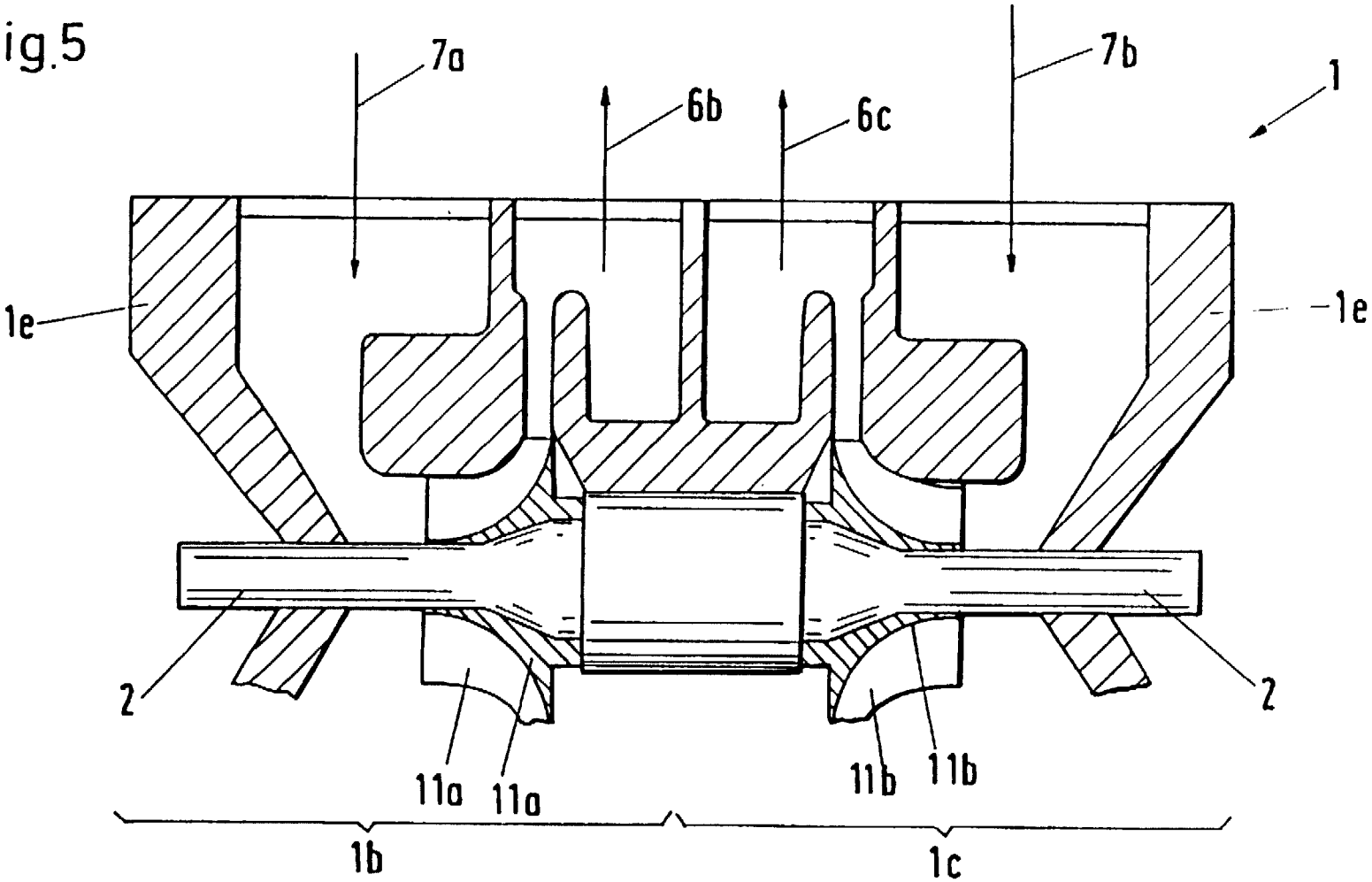
FIG. 5 is a partial view of a longitudinal section through a compressor; and, FIG. 6 is a further exemplary embodiment of an arrangement of compression stages.

FIG. 4 shows the exemplary embodiment shown in FIG. 2*b* in a more detailed layout. The shaft 2 shown in FIG. 2*b* is divided into two separate shafts in the exemplary embodiment in accordance with FIG. 4 which are connected to one another via a connector shaft 2*a*. The compression apparatus 10 comprises two compressors 1, which are connected to one another via the connector shaft 2*a*as well as the mixer devices 8*a*, 8*b*, 8*c* and the connection lines 5*a*, 5*b*, 5*c*, 5*d*, 6*a*, 6*b*, 6*c*, 6*d* carrying fluid flows. Each of the compressors 1 has two compression stages 1*a*, 1*b*, 1*c*, 1*d* which, as shown in FIG. 5, are arranged counter to one another on the shaft 2. A drive means 12, for example an electric motor, a gas turbine or a steam turbine, drives the first shaft 2, with this first shaft 2 being connected via the connector shaft 2*a* directly or via a gearbox to the shaft 2 of the second compressor 1 and driving this second shaft 2. Inlet and outlet openings of the compression stages 1*a*, 1*b*, 1*c*, 1*d* are led outwardly so that the mixer devices 8*a*, 8*b*, 8*c* can be arranged outside the compressor 1 and correspondingly connected by tubes in order to appropriately conduct the base flow 5*a*, the infeed flows 5*b*, 5*c*, 5*d* as well as the main flows 6*a*, 6*b*, 6*c* and the end flow 6*d*.

FIG. 5 shows the upper part of a longitudinal section through a compressor 1 as was used in FIG. 4. The compressor housing 1*e* has correspondingly formed channels so that the refrigerant flow 7*a*, 7*b* enters the compressor 1, is compressed by the rotors 11*a*, 11*b*, and leaves the compressor 1 as an output flow or main flow 6*b*, 6*c* respectively. Thus the compressor 1 shown has two compression stages 1*b*, 1*c*. Since the flow entering into the compressor 1 is arranged at the free end of the shaft 2, the shaft 2 and thus the entry diameter of the rotor can be made relatively small. The arrangement in accordance with FIG. 5 allows the use of a relatively thin shaft 2 and rotors 11*a*, 1*b* of small diameter. Such rotors 11*a*, 11*b* have a lower Mach number, which brings about a higher flow stability of the fluid in the compressor 1, especially in the rotor 11*a*, 11*b*.

Figure 6:
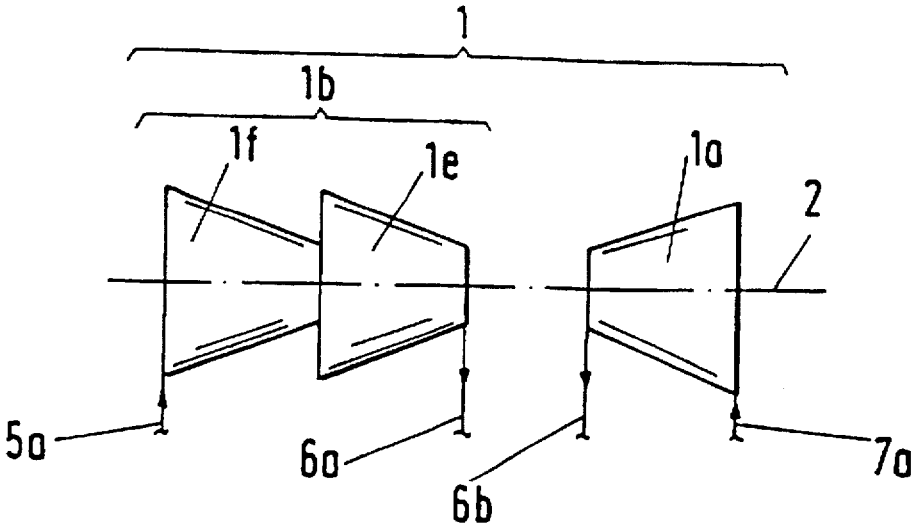

FIG. 6 shows a further exemplary embodiment of a compressor 1 which on the right side has a compression stage 1*a* with one compressor stage, and on the left side a compression stage 2*a* with two compressor stages 1*e*, 1f connected in series, so that the refrigerant flow 5*a* leaves again only at the main flow 6*a*. A compressor stage 1*e*, if is understood to mean a compressor stage which has only a single rotor for performing the compression. A compression stage 1*a*, 1*b* can have a single compressor stage 1*e*, 1*f* or a plurality of compressor stages 1*e*, if connected in series.

What is claim is:

1. A multi-stage turbocompressor for a refrigerant circuit comprising:

a first turbocompressor stage for receiving gas at an inlet and discharging compressed gas at a first stage outlet;

a second and successive turbocompressor stage for receiving compressed gas from the first turbocompressor stage with gas infeed of additional gas and discharging compressed infeed and compressed gas at a second stage outlet;

a third and successive turbocompressor stage for receiving compressed gas from the second and successive turbocompressor stage with gas infeed of additional gas and discharging compressed infeed and compressed gas at the third and successive stage outlet;

a process for receiving the compressed gas from the outlet of the last successive turbocompressor stage and relaxing pressure on the compressed gas to generate the gas infeed;

a first mixer for receiving compressed gas from the first stage outlet of the first turbocompressor stage and gas infeed from the process and discharging mixed compressed gas and infeed to the second and successive turbocompressor stage inlet; and, a second mixer for receiving compressed gas from the second stage outlet of the second and successive turbocompressor stage and gas infeed from the process and discharging mixed compressed gas and infeed to the second and successive turbocompressor stage inlet whereby the inlet to the second and successive turbocompressor stage and the inlet to the third and successive turbocompressor stage receives uniformly mixed compressed gas and infeed with a homogenous temperature distribution.

2. A multi-stage turbocompressor for a refrigerant circuit according to claim 1 comprising:

a fourth and successive turbocompressor stage for receiving compressed gas from the third and successive turbocompressor stage with gas infeed of additional gas and discharging compressed infeed and compressed gas at the fourth and successive stage outlet; and, a third mixer for receiving compressed gas from the third stage outlet of the third and successive compressor stage and gas infeed from the process and discharging mixed compressed gas and infeed to the fourth and successive compressor stage inlet.

3. A multi-stage turbocompressor for a refrigerant circuit according to claim 1 comprising:

the first mixer and the second mixers are static mixers.

4. A multi-stage turbocompressor for a refrigerant circuit according to claim 1 comprising:

the multi-stage turbocompressors are driven on a common shaft.

5. A multi-stage turbocompressor for a refrigerant circuit according to claim 1 comprising:

the multi-stage turbocompressors are driven on a plurality of separate shafts.

6. A multi-stage turbocompressor for a refrigerant circuit according to claim 1 comprising:

at least two of the turbocompressors are driven on a common shaft and arranged with axial fluid flow counter to one another.

7. A multi-stage turbocompressor for a refrigerant circuit according to claim 2 comprising:

at least two of the turbocompressors are driven on a first common shaft; and, at least two of the remaining turbocompressors are driven on a second common shaft.

8. A multi-stage turbocompressor for a refrigerant circuit according to claim 1 comprising:

the refrigerant circuit has refrigerant selected from the group consisting of propane, ethylene, methane, or a mixture thereof.

9. A multi-stage turbocompressor for a refrigerant circuit according to claim 1 comprising:

the refrigerant circuit is located in a LPG installation.

10. A multi-stage turbocompressor for a refrigerant circuit according to claim 1 comprising:

the refrigerant circuit is located in a LNG installation.

* * * * *